United States Patent [19]

Bird

[11] Patent Number: 4,911,289

[45] Date of Patent: Mar. 27, 1990

[54] CARRIER FOR BEVERAGE BOTTLES

[76] Inventor: Stanford W. Bird, 745 Three Fountains Cir., Salt Lake City, Utah 84107

[21] Appl. No.: 338,885

[22] Filed: Apr. 17, 1989

[51] Int. Cl.[4] ..... B65D 75/00

[52] U.S. Cl. ..... 206/150; 206/151; 206/158; 206/427

[58] Field of Search ..... 206/139, 148, 149, 150, 206/151, 158, 194, 199, 427; 294/151, 159, 172

[56] References Cited

U.S. PATENT DOCUMENTS

| | | | |
|---|---|---|---|
| 2,989,177 | 6/1961 | Swick | 206/150 |
| 3,404,773 | 10/1968 | Kirby, Jr. | 206/158 |
| 3,627,121 | 12/1971 | Deasy | 206/151 |
| 3,721,337 | 3/1973 | Braun et al. | 206/150 |
| 3,884,354 | 5/1975 | Guenther et al. | 206/427 |
| 4,487,312 | 12/1984 | Heidel | 206/158 |
| 4,651,873 | 3/1987 | Stolcenberg et al. | 206/199 |
| 4,712,680 | 12/1987 | Panazzolo | 206/148 |

FOREIGN PATENT DOCUMENTS

| | | | |
|---|---|---|---|
| 122169 | 1/1972 | Denmark | 206/199 |
| 2098831 | 3/1972 | France | 206/150 |

*Primary Examiner*—David T. Fidei
*Attorney, Agent, or Firm*—M. Reid Russell

[57] ABSTRACT

A carrier for beverage bottles comprising a sheet of flat, strong plastic material having four equally spaced corner areas, and a bottle hole through each corner area and a portion of said sheet curved around each bottle hole and having a pull tab projecting therefrom; and a pair of oppositely positioned short-radius, inwardly curved edges and a pair of oppositely positioned longer-radius, inwardly curved edges forming connecting edges between corner areas.

3 Claims, 1 Drawing Sheet

CARRIER FOR BEVERAGE BOTTLES

BRIEF DESCRIPTION OF THE INVENTION

1. Field of the Invention

This invention relates to low cost, easily used carriers for beverage bottles.

2. Prior Art

Plastic bottles for containing bulk sized quantities, of beverages, such as soft drinks, fruit juices and the like have become more and more popular. At the present time, for example, a two-liter bottle is frequently used for packaging of such beverages. The bottles generally include a top neck that defines an opening into and out of the bottle, exterior threads on the neck and a projecting flange serves as a stop ring at the lower end of the threads. A generally cup-shaped lid, having interior threads is threaded onto the neck and seats against the stop ring.

It has been found to be difficult to carry a single one of the filled beverage bottles described, since the bodies of the bottles are too large and slippery to be easily grasped and the weight of the filled container is such that a user, particularly a child or a woman, cannot hold the bottle by the neck or lid.

Generally, the most acceptable means for carrying a beverage bottle as described is by placing it in a shopping bag and then grasping the bag. The problem is severely compounded when a user desires to carry more than one of the described bottles. Again, it usually becomes necessary for a user, such as a customer at a store, to place more than one such bottle in a shopping bag or to have a shopping bag for each bottle. In any event, it is difficult for the user to handle and carry either a single such bottle or a plurality of the bottles.

3. Object of the Invention

Principal objects of the present invention are to provide a low-cost carrier that can be easily used to carry one or more beverage bottles; that can be readily installed by any user; and that is easily individually separated from each beverage bottle as desired.

4. Features of the Invention

Principal features of the invention include a flat sheet of suitable strength plastic, four corner holes, and circular corners interconnected by short-radius arcuate curves on two opposite sides and two longer-radius arcuate curves on other opposite sides. A pair of notches are provided at opposite sides of each corner hole and tabs project from each circular corner to facilitate placement and removal of the carrier with respect to a beverage bottle. A carrying handle is formed centrally of the sheet and extends longitudinally and centrally between the sides of the sheet having short-radius curves formed therein. The handle includes a strap that terminates short of each side edge having a longer radius curve of the strap to permit a user's fingers to grasp the strap.

Other objects and features of the invention will become apparent from the following detailed description and drawing disclosing what are presently contemplated as being the best modes of the invention.

THE DRAWING

In the drawing:

FIG. 1 is a top plan view of a carrier of the invention;

FIG. 2 a side elevation view; and

FIG. 3 a perspective view of the carrier of the invention shown installed on beverage bottles, the bottles being shown fragmentarily and in phantom.

DETAILED DESCRIPTION

Figure 1:
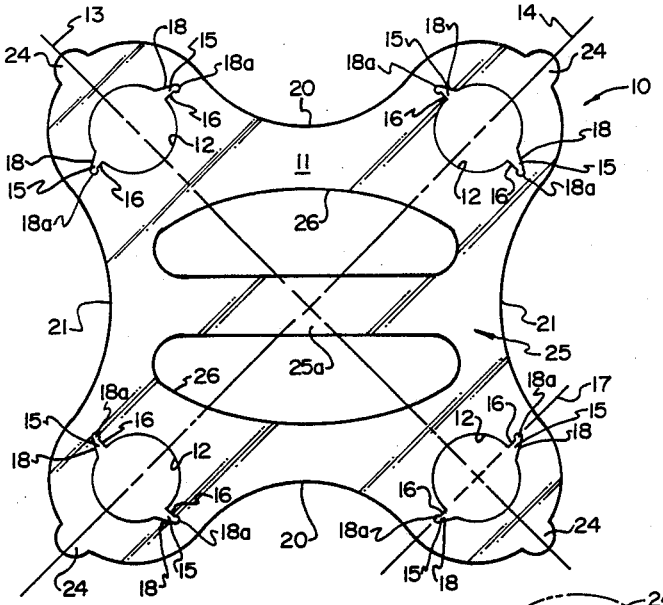
Figure 2:
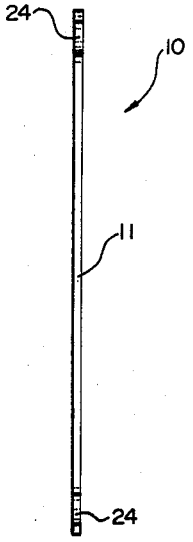
Figure 3:
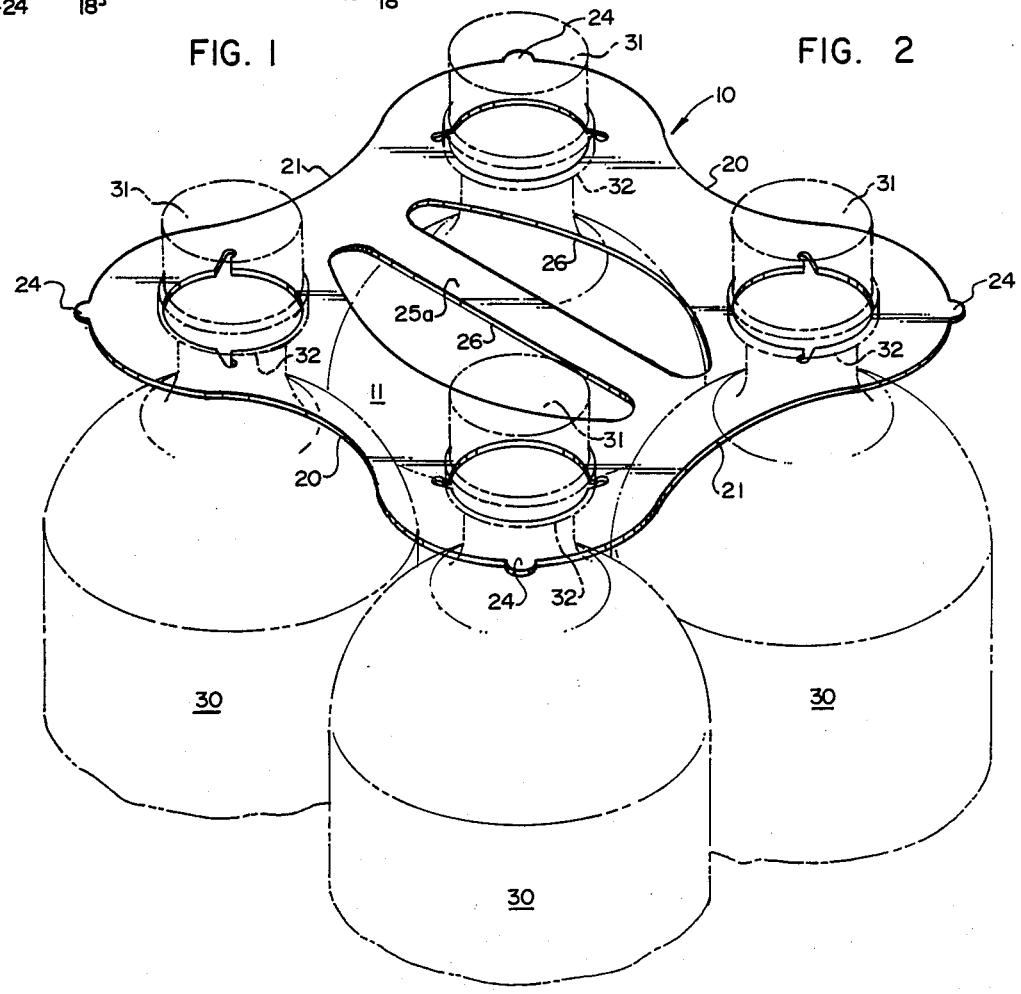

Referring now to the drawing:

The illustrated preferred embodiment of the carrier for beverage bottles of the invention is shown generally at 10.

As shown, the carrier 10 includes a flat sheet 11 of suitable strength, flexible plastic having a circular hole 12 in each of the four corners thereof. The holes 12 are formed on right angle intersecting lines 13 and 14 and each hole has a pair of notches 15 extending outwardly therefrom.

The notches 15 each include a short edge 16 that is substantially on a diameter line 17 extending transversely to a line 13 or 14, a longer angled edge 18 that extends from the line 17, a spaced distance from edge 16 at the side opposite the intersection of lines 13 and 14 outwardly to the line 17 beyond the end of short edge 16. A circular punch hole **18*a* connects the short edge 16 and the longer angled edge 18 and projects beyond the line 17**.

The corner edges 19 of sheet 11 are preferably curved to conform to the holes 12 and two pair of adjacent corner edges 19 are interconnected by a pair of short-radius curved edges 20, with the edges 20 then being at opposite sides of the sheet 11.

Similarly, two other pair of adjacent holes 12 are interconnected by longer-radius edges 21, with the edges 21 being at opposite sides of sheet 11. The edges 21, like the edges 20 are centrally curved into the sheet 11 and are connected at their ends to the curved corners of the sheet 11.

A pull tab 24 is formed at each corner of sheet 11. A handle 25 is formed in the sheet 11 and as a strap **25*a* with openings 26 on opposite sides thereof through which a user's fingers may be inserted to grasp the strap 25. The strap extends centrally between the short-radius curved edges 20 and the ends thereof terminate adjacent to the longer-radius curved edges 21**.

In use, the carrier 10 is positioned to have one or more of the holes 12 located over the top of a bottle 30 to be carried. The carrier is then worked down over the cap 31 of each such bottle until the corner thereof is fully past the bottle cap and the stop ring 32 of the bottle neck. As the sheet material surrounding the holes is moved down the cap, the notches 15 allow the flexible material to be worked past the ring 32.

Lifting of the carrier 10 will then cause the sheet 11 to pull up centrally and the sheet material surrounding the holes 12 to engage the ring 32 or the bottom of the cap as the bottles are lifted. Because of the short-radius curved edges, the longer-radius curved edges and the arrangement of the handle, lifting on the handle causes the sheet 11 to pull tightly against the neck of each bottle and the bottle or bottles are securely held as they are lifted. However, when the handle is released each bottle is easily removed, with the tabs 24 and notches 15 being used to lift the corners of sheet 11 from the bottle tops.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A carrier for beverage bottles comprising a sheet of flat, strong plastic material having four equally spaced corner areas;

a bottle hole through each corner area and a portion of said sheet curved around each bottle hole;

a pair of short-radius curved edges each interconnecting two adjacent portions of the sheet curved around bottle holes, being upwardly curved with respect to said sheet and spaced at opposite sides of the sheet;

a pair of longer-radius curved edges formed with a radius longer than that of the short-radius curved edges each interconnecting two other adjacent portions of the sheet curved around bottle holes, being inwardly curved with respect to said sheet and being spaced at opposite sides of the sheet; and elongate handle means centrally formed in the sheet between the short-radius curved edges and extend between the longer-radius curved edges.

2. A carrier as in claim 1, further including a pair of spaced apart notches extending from opposite sides of the bottle holes.

3. A carrier as in claim 2, wherein the notches each have a straight edge extending from the bottle hole and an angled edge extending outwardly from the bottle hole to engage the straight edge.

* * * * *